US010590646B2

(12) United States Patent
Visser

(10) Patent No.: US 10,590,646 B2
(45) Date of Patent: Mar. 17, 2020

(54) COMPOSITE BUILDING PANEL AND SHELL

(71) Applicant: Wall Technologies Pty Ltd, Kilsyth (AU)

(72) Inventor: David Visser, Kilsyth (AU)

(73) Assignee: WALL TECHNOLOGIES PTY LTD., Kilsyth (AU)

( * ) Notice: Subject to any disclaimer, the term of this patent is extended or adjusted under 35 U.S.C. 154(b) by 0 days.

(21) Appl. No.: 16/132,959

(22) Filed: Sep. 17, 2018

(65) Prior Publication Data

US 2019/0226204 A1 Jul. 25, 2019

(30) Foreign Application Priority Data

Jan. 24, 2018 (AU) ..... 2018900228

(51) Int. Cl.
*E04B 1/94* (2006.01)
*E04B 1/61* (2006.01)
(Continued)

(52) U.S. Cl.
CPC ..... *E04B 1/942* (2013.01); *E04B 1/14* (2013.01); *E04B 1/615* (2013.01); *E04C 2/04* (2013.01);
(Continued)

(58) Field of Classification Search
CPC ..... E04C 2/04; E04C 2/06; E04C 2/28; E04C 3/29; E04C 5/073; E04C 2/26; E04C 2/292; E04C 3/07; E04C 2003/0413; E04C 2/38; E04C 2003/043; E04C 2002/004; E04B 1/942; E04B 1/14; E04B 7/20; E04B 2002/0204; E04B 2002/0228;
(Continued)

(56) References Cited

U.S. PATENT DOCUMENTS 2,975,874 A * 3/1961 Alberto ..... E04C 3/07 138/157
3,742,672 A * 7/1973 Schaeufele ..... E04B 1/54 52/592.1
(Continued)

FOREIGN PATENT DOCUMENTS

AU 707873 6/1998
CA 2766628 A1 * 7/2013 ..... E04B 2/00
(Continued)

OTHER PUBLICATIONS

International Search Report dated May 6, 2019 for PCT/AU2019/050042.

*Primary Examiner* — Jessie T Fonseca
(74) *Attorney, Agent, or Firm* — Suiter Swantz pc llo

(57) ABSTRACT

An outer shell for a composite building panel includes a tongue and correspondingly shaped groove formed on opposite side edges thereof for interlocking like panels to form a wall. The tongue extends outwardly from the side edge of the panel and has a forward portion with parallel sides which are straight and parallel to a central plane of the panel. The tongue has an intermediate portion that tapers outwardly from the parallel sides toward a side face of the panel. The tongue has a rearward portion with parallel sides. Inner faces of the groove are configured for close engagement of the forward and rearward portions of the tongue.

20 Claims, 9 Drawing Sheets

(51) Int. Cl.

| | |
|---|---|
| ***E04C 2/28*** | (2006.01) |
| ***E04C 2/38*** | (2006.01) |
| ***E04B 1/14*** | (2006.01) |
| ***E04C 2/04*** | (2006.01) |
| ***E04C 2/06*** | (2006.01) |
| *E04B 2/02* | (2006.01) |

(52) U.S. Cl.
CPC ..... *E04C 2/06* (2013.01); *E04C 2/28* (2013.01); *E04C 2/38* (2013.01); *E04B 2002/0204* (2013.01); *E04F 2201/023* (2013.01)

(58) Field of Classification Search
CPC ..... E04B 1/6133; E04F 2201/01; E04F 2201/02; E04F 2201/023; E04F 2201/028; E04F 13/0894
See application file for complete search history.

(56) References Cited

U.S. PATENT DOCUMENTS 4,028,859 A * 6/1977 Bellagamba ..... E04C 2/292 52/393
4,100,710 A * 7/1978 Kowallik ..... E04C 2/292 52/309.9
4,140,824 A * 2/1979 Gaillard ..... E04B 1/86 428/81
4,186,539 A * 2/1980 Harmon ..... E04B 1/6129 52/580
4,589,240 A * 5/1986 Kendall ..... E04C 2/292 49/501
5,274,979 A * 1/1994 Tsai ..... E04C 2/292 52/588.1
5,293,728 A * 3/1994 Christopher ..... F16B 5/0016 52/309.9
6,122,879 A * 9/2000 Montes ..... E04F 13/0876 52/309.9
6,182,409 B1 * 2/2001 Visser ..... E04B 7/20 52/284
6,212,845 B1 * 4/2001 De Zen ..... E04B 1/12 52/607
6,223,493 B1 5/2001 Ruggeri
6,247,281 B1 * 6/2001 Lin ..... E04C 2/292 52/309.4
6,415,576 B1 * 7/2002 Stromback ..... E04C 3/07 428/35.8
7,377,082 B1 * 5/2008 Edwards ..... E04C 2/292 52/309.9
7,540,123 B1 * 6/2009 Semmes ..... E04C 2/292 52/783.14
8,677,713 B1 * 3/2014 Sheehy ..... E04C 2/20 52/284
2001/0034992 A1 11/2001 Pletzer et al.
2002/0083673 A1 * 7/2002 Kettler ..... E04F 15/04 52/578
2004/0035077 A1 * 2/2004 Martensson ..... E04B 1/6129 52/578
2004/0050007 A1 * 3/2004 Curatolo ..... E04F 15/10 52/592.1
2004/0141804 A1 7/2004 Olofsson et al.
2010/0095613 A1 * 4/2010 Paetkau ..... E04B 1/14 52/220.1
2010/0255256 A1 * 10/2010 Carolan ..... B29C 44/326 428/158
2011/0173925 A1 * 7/2011 Brown ..... E04B 1/14 52/794.1

FOREIGN PATENT DOCUMENTS

WO 03095762 A1 11/2003
WO 2018085881 A1 5/2018

* cited by examiner

COMPOSITE BUILDING PANEL AND SHELL

PRIORITY

The present application claims priority to Australian Provisional Patent Application No. 2018900228, filed Jan. 24, 2018, entitled Composite Building Panel and Shell, naming David Visser as inventor, which is incorporated herein by reference in the entirety.

FIELD OF THE INVENTION

The present invention relates to composite building panels, particularly to composite building panels of the type that have an outer shell and a concrete infill material. The present invention also relates to shells for composite building panels.

BACKGROUND

Composite building panels of the type that typically have a sheet metal outer shell that is then infilled with a concrete material are well known. Typically, these panels are rectangular in side profile and include alongside edges corresponding tongue and grove features to allow for interlocking of like panels to form a wall.

Such panels are very effective at resisting fire and have a very long time to complete failure once compromised as they maintain their structural integrity. Even if significant cracks occur in a wall made of such panels (which typically occur at the join) and flames can pass through, the remainder of the wall will remain in place so that only a small amount of flames are able to pass through, thereby restricting the spread of fire. Accordingly, a fire can burn within the building without catastrophic failure and even during a large scale fire, the wall contributes to the structural integrity of the building even when damaged. This is in contrast to plaster panels having a fire resistant coating, which tend to reach catastrophic failure very quickly once the coating has been damaged and the core of the material is exposed to the fire and heat.

It has been observed that in most building fires there is a limited availability of fuel so that if the walls can remain in place without failure, the fire will eventually burn out without catastrophic building failure. This is particularly true in apartment complexes where previous fires have led to wall failure and then spread quickly through the building, leading to large human and financial cost.

Furthermore, due to their strength composite panels having a sheet metal outer shell and concrete infill are better able to resist seismic loading without catastrophic failure compared to other commonly used internal wall systems. Even if a small amount of damage occurs during the seismic event the fire rating of the wall remains high, which is important as fires often follow seismic events.

Previous composite panels, such as those described in Australian patent no. 707873 for example, have a tongue having a square or generally rectangular profile, which provides some resistance to buckling, though due to the shallow tongue creates gaps in the wall that can reduce fire ratings. In panels having a square tongue, the stress of the wall is carried at the base of the tongue, thereby limiting its strength. Also, other previous panels have had a tongue with a general wedge shape that, when engaged with a corresponding groove under force, acts to open up the groove under buckling loads or when a force is applied to one side, thereby limiting the strength of the wall. The result is that the weakest point of a wall made with such panels is the interface or join between two adjacent panels.

It is also known to add grooves or ridges within the structure of the panel for decorative purposes and to improve the visual appearance by preventing bubbling and/or oil canning. It has been discovered that composite building panels of this kind can suffer from a failure problem when subjected to a sudden and sever vibratory load. This type of load can occur when a building that has been constructed from these types of composite building panels is subjected to an earth tremor or earthquake.

While subjected to a severe vibratory load, the interface between the inner wall of the outer shell and the concrete infill material may slip, relative to one another. This can impose excessive compressive and/or strain load on the concrete material, causing the concrete material to lose its structural integrity and for the entire panel to fail, sometimes catastrophically.

In another mode of failure, as the composite building panel is subjected to the tensile and compressive loads imposed upon it by a geological event, the outer shell may buckle and/or rupture, and this may also cause the concrete infill material to catastrophically fail. Other typical modes of failure attributed to geological events are caused by the likely aftershocks that occur.

There is a need to address the above, and/or at least provide a useful alternative.

SUMMARY

According to the invention there is provided an outer shell for a composite building panel having a tongue and correspondingly shaped groove formed on opposite side edges thereof for interlocking like panels to form a wall, wherein the tongue extends outwardly from the side edge of the panel and has a forward portion with parallel sides which are substantially straight and substantially parallel to a central plane of the panel, and a rearward portion that tapers outwardly from the parallel sides toward a side face of the panel, wherein inner faces of the groove are configured for close engagement of the forward and rearward portions of the tongue.

According to preferred embodiments of the invention, substantially the entire exterior and interior surface of the shell, excluding the tongue and groove, includes an embossed pattern. The embossed pattern can be a repeating pattern. The repeat pattern is preferably a geometric shape.

Preferably, the embossed pattern on the interior surface of the shell provides increased grip between an infill material and the inner surface of the shell.

The shell can be fabricated from sheet metal. The shell preferably is fabricated from two sheets, the sheets overlapping each other at the tongue portion and the groove portion to provide additional strength at the tongue portion and groove portion. In preferred embodiments, an end of each sheet extends 5 to 10 mm along a side of the parallel portion or a corresponding portion of the groove portion. More preferably, the sheets overlap on the parallel portion and the groove portion so as to provide for engagement of four layers of sheet material at corners of the groove portion/tongue portion.

According to the invention there is also provided a composite building panel having an outer shell of the above described type and a concrete infill material.

In preferred embodiments, the infill material fills the entire volume of the shell.

BRIEF DESCRIPTION OF THE DRAWINGS

In order that the invention may be more easily understood, an embodiment will now be described, by way of example only, with reference to the accompanying drawings, in which.

DETAILED DESCRIPTION

Figure 1:
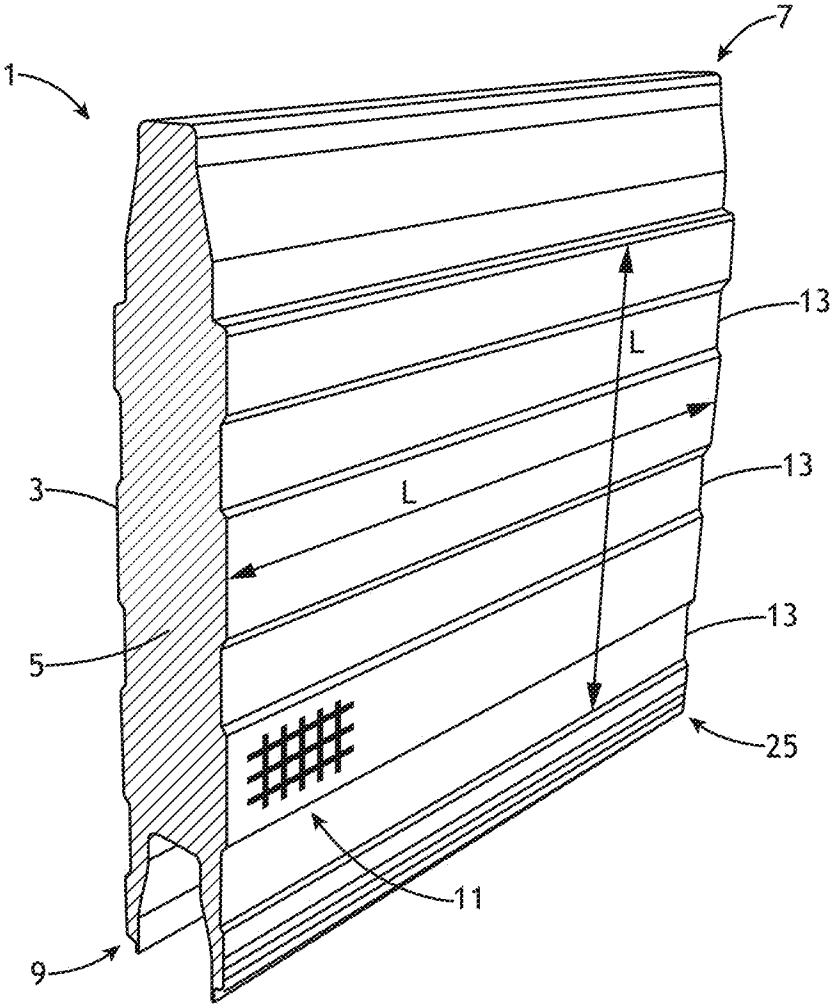
FIG. 1: is a perspective view of a composite building panel according to a preferred embodiment of the invention.

FIG. 1 illustrates a composite building panel 1 according to a preferred embodiment of the invention.

The panel 1 includes an outer shell 3 which is completely filled with a suitable concrete infill material 5. In this embodiment the panel is rectangular shaped, and includes a tongue portion 7 extending outwardly from one side edge of the panel 1 and a correspondingly configured groove portion 9 extending outwardly from an opposite side edge, whereby the tongue 7 of one panel can be received in the groove 9 of a like panel for interlocking like panels together to form a wall. Preferably, the tongue 7 and groove 9 are sized so that the tongue 7 is a tight fit into groove 9.

The tongue 7 extends outwardly from the side edge of the panel 1 and has a forward portion 15 (FIG. 6) with parallel sides 17 which are substantially straight and substantially parallel to a central plane of the panel 1, thereby creating a square or rectangular profile. In the illustrated embodiment, the tongue 7 extends along a central plane of the panel 1, i.e. the parallel sides 17 are equidistant from the central plane, though it will be appreciated that in other embodiments, the tongue 7 may be offset to one side of the central plane. The parallel sides 17 may be 12 to 30 mm long.

The tongue 7 has an intermediate portion 19 with side walls 20 that taper outwardly from the parallel sides 17 toward respective side faces 21 of the panel 1. It will be appreciated that the intermediate portion 19 may not extend all the way to the side faces 21. In the illustrated embodiment, walls 20 transition into an "S" shape before reaching the side faces 21. In this regard, a rearward portion 22 also with parallel sides 24 is disposed between the intermediate portion 20 and the side faces 13. Importantly, inner faces 23 (FIG. 2) of the groove 9 are configured for close engagement of the forward, intermediate and rear portions 15, 19, 22 of the tongue 7.

This straight/wedge/straight wall configuration on the tongue can result in superior fitment of like panels. In this regard, the initial straight section, forward portion 15, allows for an improved structural interlock between the panels. The wedge, intermediate portion 19, allows for two like panels to fit snugly together, providing a good air seal. Rearward portion 22 also provides an improved structural interlock, as well as a flat face that allows screws to be used to secure two like panels together. The combination of these features provides a greatly improved connection over the prior art.

Preferably, the intermediate portion 19 is between 20 and 45 mm long, with side walls 20 having a taper angle in the order of 3 to 30 degrees. Rear portion 24 is also preferably between 12 and 30 mm long.

With previous panels with a tapered tongue and corresponding groove, when interlocked and a force is applied to one side or a buckling load otherwise induced, the groove of one panel tends to open up, which can allow the tongue to escape and the wall to fail, thereby limiting the strength of the wall.

Figure 6:
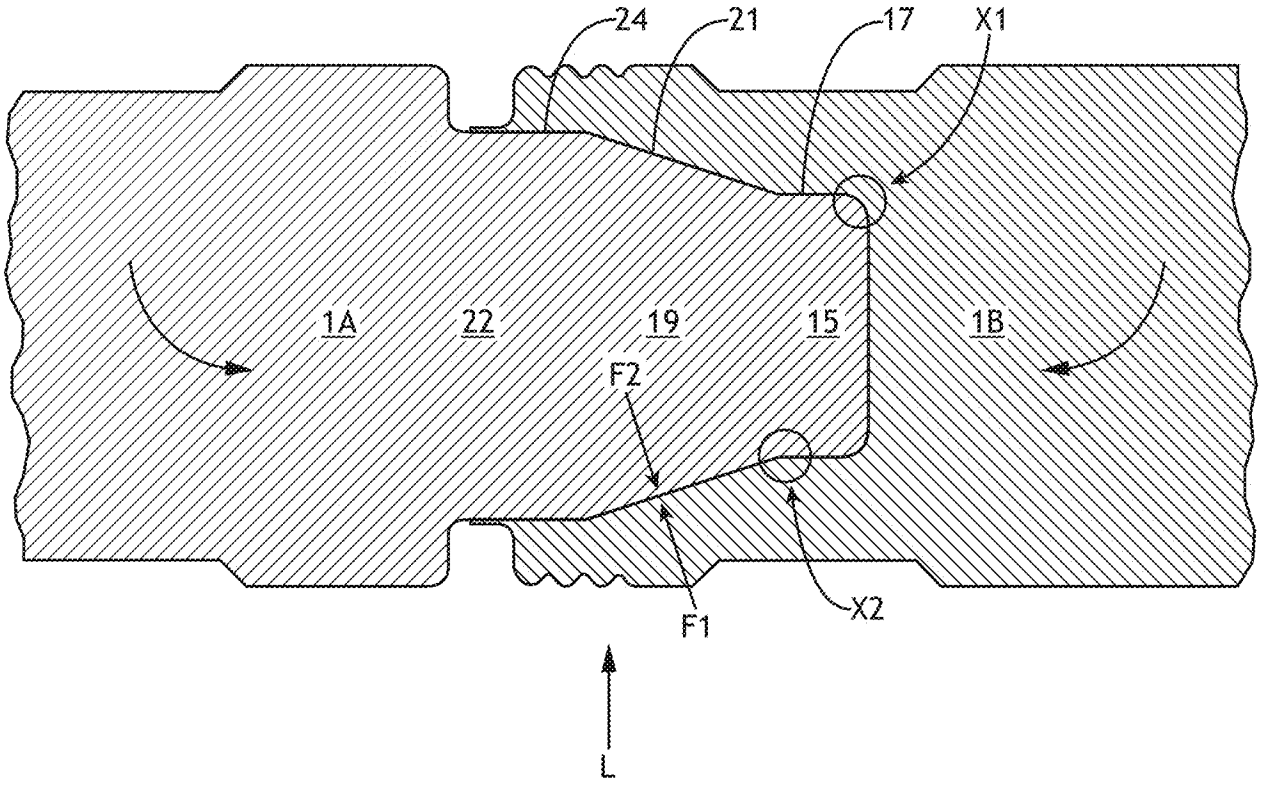
FIG. 6: is a close view of the panels of FIG. 5.

With the present panel 1, the described forward portion 15 allows for positive engagement of the tongue 7 with the corresponding section of inner face 23 of groove 9 to prevent buckling of the wall. FIG. 6 illustrates how this can be achieved. In particular, under side load L panel 1A tends to rotate counter clockwise and panel 1*b* tends to rotate clockwise. This causes increased surface pressure at locations X1 and X2, forcing the top corner edge of the tongue 7 into the corresponding corner of the groove 9, which acts to counter rotation of the panels and prevent buckling and/or bending of the wall. Furthermore, the tapered walls of the intermediate portion 19 of the tongue 7 act to transfer a percentage of the force along the joint. In this regard, a face of the tapered portion 20 bears against a corresponding face of the groove 9, resulting in forces each in a direction normal to their respective surfaces. This force is at an angle to a central plane of the panel 1 and includes vector components acting in vertical and horizontal directions, thereby creating a "sideways" force that forces the end of the tongue 7 into the groove 9 at location X1 and resists pulling apart of the panels. Also, owing to the engagement between the faces a frictional resistance to pulling out is also created.

Advantageously, panel 1 takes the benefits of panels having a generally square tongue/groove and combines them with a tapered tongue/groove (whereas previous panels had either configuration) to result in a panel providing a longer engagement area and having greatly improved buckling and fire resistance.

Panel 1 provides a deep square joint so that in the event of fire, even as gaps open between panels, the tongue and groove features do not provide a clear path for a fire to propagate, thereby reducing fire spread within a building.

The shell 3 is formed from a sheet material, which is preferably sheet metal, and which is preferably 0.2 to 0.7 mm thick. The shell 3 is formed from multiple parts that come together with a male/female interlocking fit. The location of the edges of each sheet is selected to create a stiffer panel at the point where loading is high, particularly near the tongue portion 7 and groove portion 9.

Figure 7:
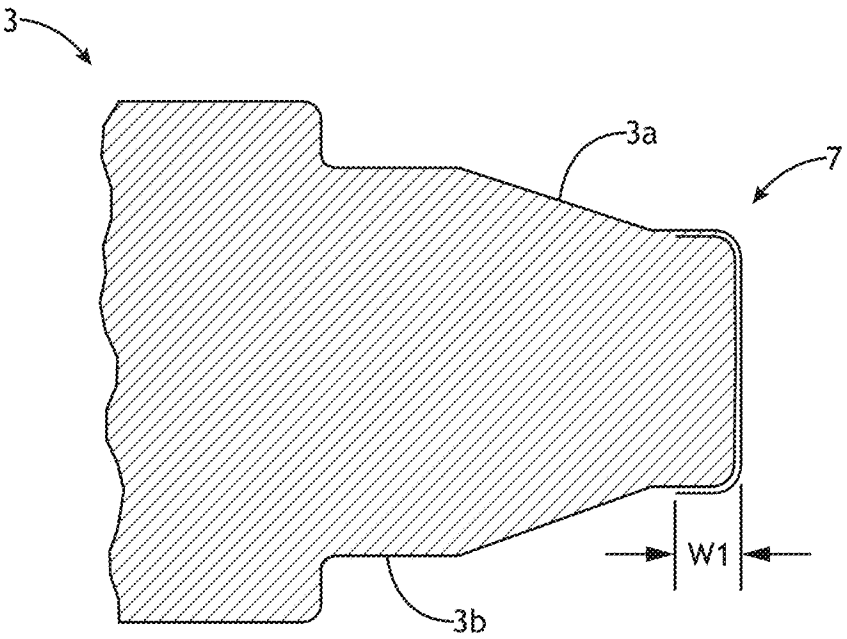
FIG. 7: is a close view of a tongue portion of a shell for use in the panel.
Figure 8:
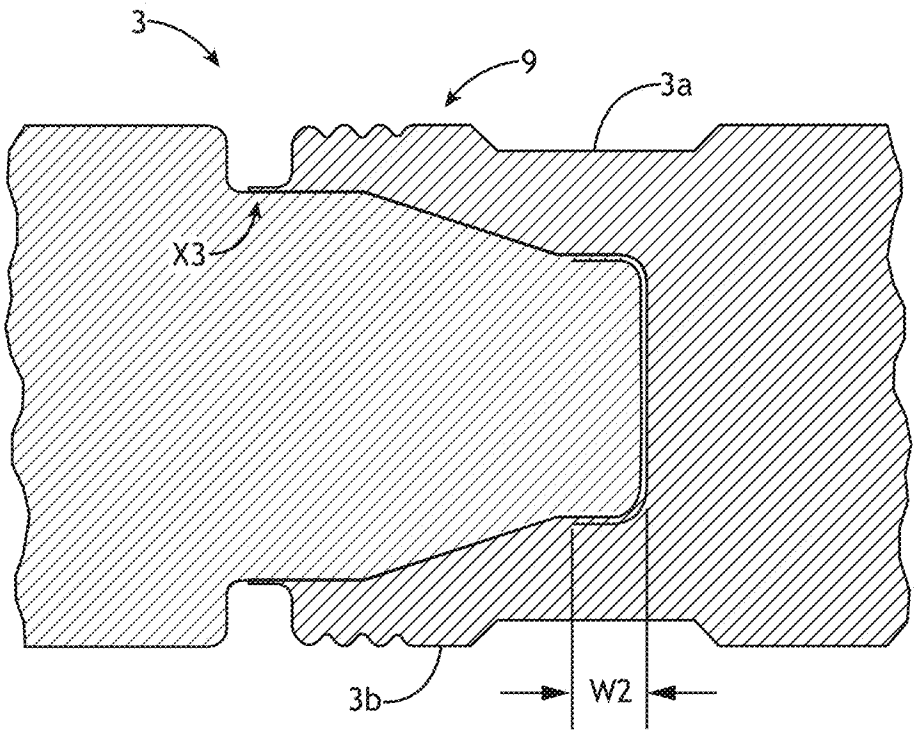
FIG. 8: is a close view of a groove portion of the shell.

As illustrated in FIGS. 7 and 8, the shell 3 is formed of two sheets 3*a*, 3*b*, with each sheet overlapping the other at the tongue portion 7 and the groove portion 9. At the tongue portion 7, as illustrated in FIG. 7, an end of each sheet extends a distance W1 from a tip of the tongue portion 7 along the side of each of the parallel wall portions 17 so that both corners of the tongue portion have a twin walled shell. Preferably, distance W1 is 5 to 10 mm. This provides that at the point of stress concentration X1 additional material is provided to resist deformation under buckling load, thereby strengthening the tongue portion 7 and the joint and further preventing buckling of the wall.

At the groove portion 9, as shown in FIG. 8, sheets 3*a*, 3*b* also overlap so as to provide additional strength to the groove portion 9 at point of stress concentration X1. Again, the sheets overlap a distance W2 alongside walls of the groove, that distance preferably being 5 to 10 mm. The overlap of the sheets 3*a*, 3*b* in the groove portion 9 also act to resist deformation under buckling load, thereby strengthening the groove portion 9 and the joint and further preventing buckling of the wall.

Figure 9:
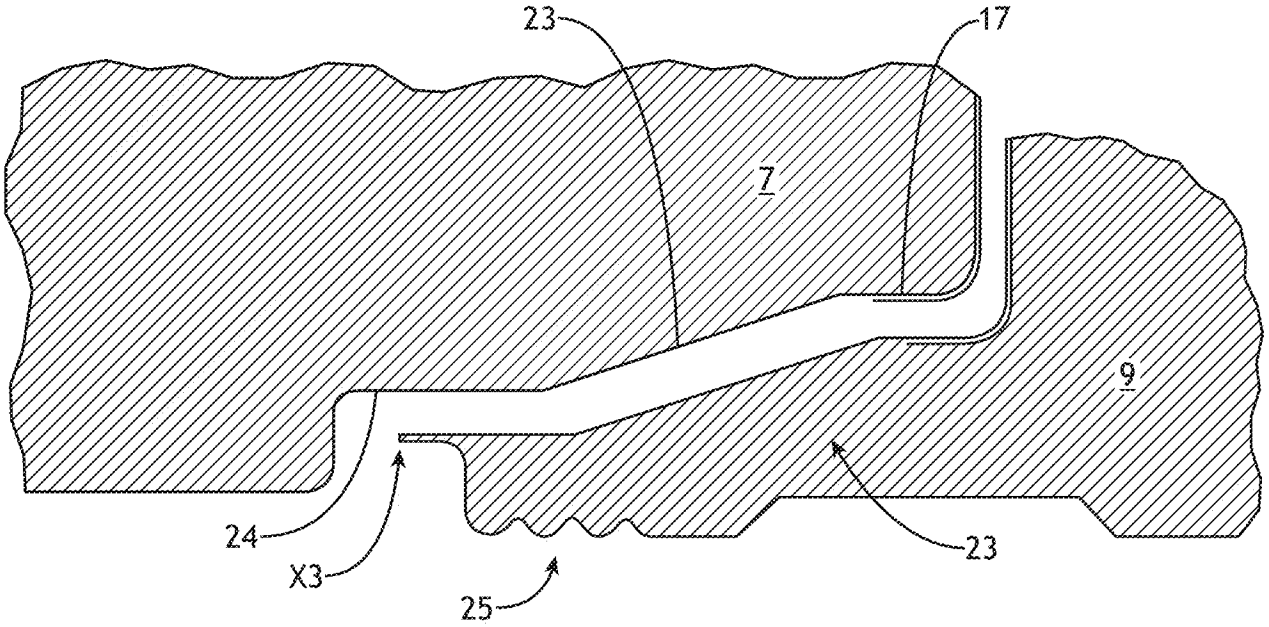
FIG. 9: is a very close exploded view of a tongue portion and groove portion.

As can be seen in FIG. 9, by overlapping the shell at the tongue portion 7 and the groove portion 9, the result will be 4 layers of material in engagement with each other at critical loading points. Although the overlapping areas are only small in size, owing to the additional material thickness they make a great contribution to the strength of the panel, thereby resisting stretching when tensile loads are applied.

Furthermore, at location X3, the shell 3 is folded over itself to provide additional material to resist deformation. In conjunction with the single wall of the shell 3 on the rearward portion 22, against which the shell bears, three layers of steel are used to resist deformation. Although the overlapping areas are only small in size, owing to the additional material thickness they make a great contribution to the strength of the panel thereby resisting stretching when tensile loads are applied.

Along a side edge of the panel 1 the two sheets 3*a*, 3*b* are joined using common joining techniques such as punching, coining or riveting. By providing overlapping portions that extend around a side edge, the ends of the sheets are captured in place so that shear forces on the join of the two sheets 3*a*, 3*b* can be avoided with any loading being transferred to a shear load on the side of the stitch/joint, increasing the strength of the panel and resisting delamination of the sheets 3*a*, 3*b*.

Figure 2:
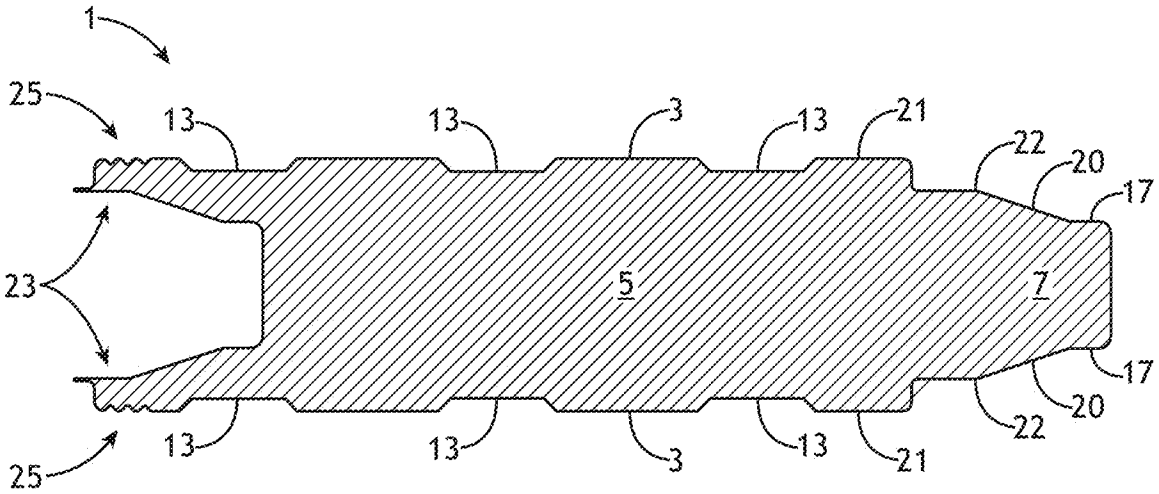
FIG. 2: is a plan view of the panel of FIG. 1.

As illustrated in FIG. 2, the composite building panel 1 includes a plurality of longitudinal grooves 13, though it will be appreciated that such grooves may be omitted. Preferably, panels of typical width, i.e. in the range of 200 mm to 400 mm, will have three grooves 13. Grooves 13 are provided to stiffen panel 1 and resist bending.

To further stiffen the panel, ripples or folds 25 may also be formed in the shell 3. Ripples 25 are provided near the groove portion 9 to further enhance the strength of the panel, particularly to prevent opening of the groove portion 9. The ripples 25 are preferably between 0.3 mm and 0.5 mm thick. Further ripples may also be disposed between ribs 13. Ripples 25 are provided near the groove 9 near an edge of the material, this point being one where stretching of the panel 1 is at a maximum. Previous panels have tended to buckle at this location, which may now be avoided.

In some embodiments, the sides of the panel 1 between the tongue portion 7 and the groove portion 9 can include an embossed repeating pattern (not shown) to improve the failure resistance of the composite building panel resulting from loads imposed upon the panel by excessive vibration, for example during major geological events, such as earthquakes.

Previously, embossing has been used for decorative purposes and the improve the visual appearance by reducing bubbling oil canning. With the present invention, embossing is used to improve the strength of the panel.

The repeating pattern can be any geometric shape, particular circular or rectilinear, however any suitable pattern could be used, and still fit within the scope of the present invention. The geometric shapes are preferably spaced so that between them further strengthening cross ribs 11 are formed extending straight across the panel in horizontal and vertical directions, as partially illustrated in FIG. 1. It will be appreciated that the embossed repeating pattern may extend partially or substantially across the entirety of the sides of the panel, in which case the patterns would extend from the tongue portion 7 to the groove portion 19 and across ribs 13, i.e. the area shown in FIG. 1 by lines L. In other embodiments, the cross ribs 11 can extend diagonally across the face of the panel. Preferably the cross ribs are between 0.3 and 0.8 mm deep. In the form of the invention illustrated in FIG. 1, an embossed repeating pattern is included on both the exterior surface of the outer shell 3 and on the interior surface of the outer shell 3.

The embossed repeating pattern that is included on the interior surface increases the grip between the concrete infill material 5 and the outer shell 3. This significantly reduces the likelihood of slippage between the outer shell 3 and the concrete infill material 5, when the composite building panel 1 is under severe vibratory load, like that experienced in an earth tremor or earthquake.

The presence of the embossed repeating pattern on the exterior surface of the outer shell enables the outer shell 3 to withstand the successive severe compressive and strain loads generated by earth tremors and earthquakes without buckling, bulging or tearing.

The embossed pattern allows the thickness of the shell material to be thinner than it would otherwise need to be. This reduces material cost, and the weight of the composite building panel. The thinner material also reduces the energy required to perform the embossing.

The combination of the enhanced grip between the in-fill material and the inner wall of the shell, and the enhanced strength, also provided by the embossing, enables the composite building panel to mitigate the risk of catastrophic failure due to the initial shock loads caused by geological event, such as an earthquake, and also subsequent repeat aftershock events.

Figure 3:
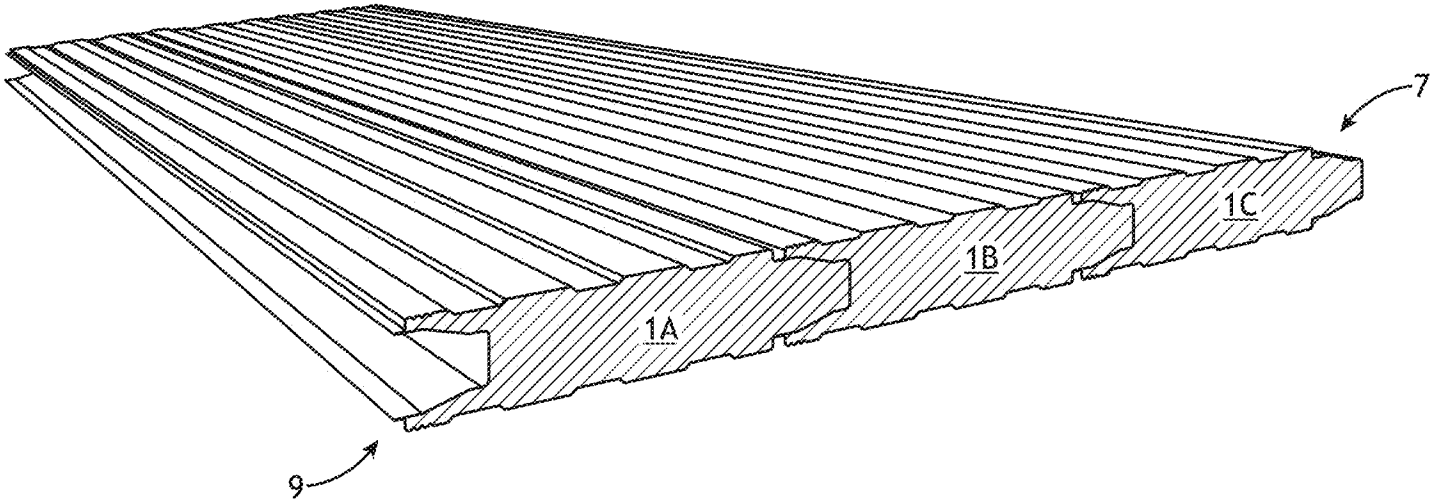
FIG. 3: is a perspective view of three like panels interconnected.
Figure 4:
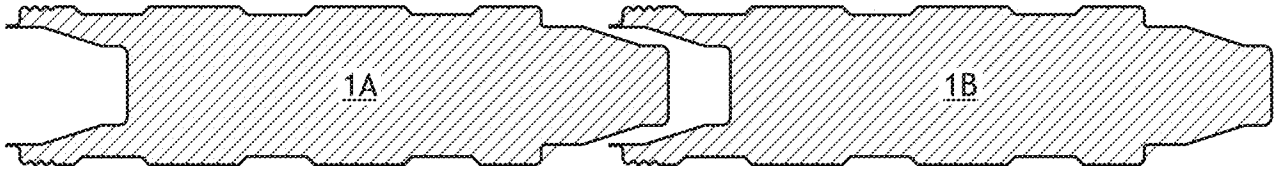
FIG. 4: is a plan view of two like panels being brought into engagement.
Figure 5:
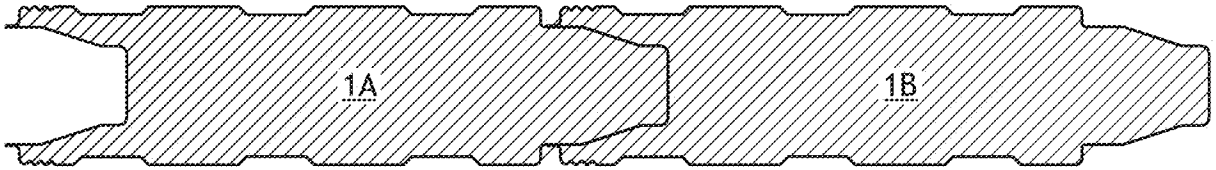
FIG. 5: is a plan view of the two panels in an engaged condition.

A plurality of like panels 1 may be interconnected as shown in FIG. 3 to form a wall. In this regard, a first wall 1A may be advanced toward a second wall 1B, or vice versa, as shown in FIG. 4. Either the first or second walls may be secured within a building (using any suitable conventional means) prior to the other wall being brought into engagement with it. Once engaged, the other wall may also be secured within the building ready for panel 1C to be installed in the wall. It will be appreciated that many panels may be interconnected to form a long wall.

While the above description includes the preferred embodiments of the invention, it is to be understood that many variations, alterations, modifications and/or additions may be introduced into the constructions and arrangements of parts previously described without departing from the essential features or the spirit or ambit of the invention.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. An outer shell for a composite building panel having a tongue and correspondingly shaped groove formed on opposite side edges thereof for interlocking like panels to form a wall, wherein the tongue extends outwardly from one of the said side edges of the panel and has a forward portion with parallel sides which are substantially straight and substantially parallel to a central plane of the panel, an intermediate portion including tapering walls which taper outwardly from the parallel sides away from the central plane towards side faces of the panel, and a rearward portion also with parallel sides extending from the intermediate portion to the side faces of the panel, wherein inner faces of the groove have parallel sides and a tapered intermediate portion that are configured for engagement with the tongue of a like panel by abutting against corresponding forward and rearward portions and a tapered intermediate portion of the tongue of the like panel.

2. An outer shell according to claim 1, wherein substantially all of an exterior and an interior surface of the shell, excluding the tongue and groove, includes an embossed pattern.

3. An outer shell according to claim 2, wherein the embossed pattern is a repeating pattern.

4. An outer shell according to claim 3, wherein the repeating pattern is a geometric shape.

5. An outer shell according to claim 2, wherein the embossed pattern on the interior surface of the shell provides increased grip between an infill material and the inner surface of the shell.

6. An outer shell according to claim 1, further comprising longitudinal folds formed on at least one of the side faces adjacent the groove for strengthening the shell around the groove.

7. An outer shell according to claim 1, wherein the shell is fabricated from sheet metal.

8. An outer shell according to claim 1, wherein the shell is fabricated from two sheets, the sheets overlapping each other at the tongue and the groove to provide additional strength at the tongue and groove.

9. An outer she according to claim 8, wherein the overlapping on the tongue and the groove are configured to lie adjacent each other in use to provide four layers of material at a corner interface.

10. An outer shell according to claim 9, wherein an end of each sheet extends 5 to 10 mm along a side of a respective parallel portion or a corresponding portion of the groove.

11. A composite building panel comprising:

an outer shell having a tongue and correspondingly shaped groove formed on opposite side edges thereof for interlocking like panels to form a wall, wherein the tongue extends outwardly from one of the said side edges of the panel and has a forward portion with parallel sides which are substantially straight and substantially parallel to a central plane of the panel, an intermediate portion including tapering walls which taper outwardly from respective parallel sides away from the central plane towards side faces of the panel, and a rearward portion also with parallel sides extending from the intermediate portion to the side faces of the panel, wherein inner faces of the groove have parallel sides that are configured for engagement with the tongue of a like panel by abutting against forward and rearward portions and a tapered intermediate portion of the tongue of the like panel; and a concrete infill material.

12. A composite building panel according to claim 11, wherein the infill material fills the entire volume of the shell.

13. An composite building panel according to claim 11, wherein substantially an entire exterior and interior surface of the shell, excluding the tongue and groove, includes an embossed pattern.

14. An composite building panel according to claim 13, wherein the embossed pattern is a repeating pattern.

15. An composite building panel according to claim 14, wherein the repeating pattern is a geometric shape.

16. An composite building panel according to claim 13, wherein the embossed pattern on the interior surface of the shell provides increased grip between an infill material and the inner surface of the shell.

17. An composite building panel according to claim 11, wherein the shell includes longitudinal folds formed on at least one of the side faces near the groove for strengthening the shell around the groove.

18. An composite building panel according to claim 11, wherein the shell is fabricated from sheet metal.

19. An composite building panel according to claim 11, wherein the shell is fabricated from two sheets, the sheets overlapping each other at the tongue and the groove to provide additional strength at the tongue and groove.

20. An composite building panel according to claim 19, wherein the over on the tongue and the groove are configured to lie adjacent each other in use to provide four layers of material at a corner interface.

* * * * *